United States Patent [19]

Libby et al.

[11] Patent Number: 4,773,470

[45] Date of Patent: Sep. 27, 1988

[54] CASTING ALUMINUM ALLOYS WITH A MOLD HEADER COMPRISING DELAMINATED VERMICULITE

[75] Inventors: Stephen C. Libby; G. Edward Graddy, Jr., both of Murrysville, Pa.

[73] Assignee: Aluminum Company of America, Pittsburgh, Pa.

[21] Appl. No.: 123,336

[22] Filed: Nov. 19, 1987

[51] Int. Cl.[4] ..... B22C 1/00

[52] U.S. Cl. ..... 164/487; 164/138; 164/459; 164/529

[58] Field of Search ..... 164/459, 418, 138, 122, 164/123, 529, 487; 249/DIG. 5, 197

[56] References Cited

U.S. PATENT DOCUMENTS

| | | | |
|---|---|---|---|
| 1,812,306 | 6/1931 | Russ . | |
| 2,462,255 | 2/1949 | Charman et al. | 164/123 |
| 3,212,142 | 10/1965 | Moritz . | |
| 4,075,804 | 2/1978 | Zimmerman | 52/232 |
| 4,111,712 | 9/1978 | Pusch | 106/120 |
| 4,128,434 | 12/1978 | Pusch | 106/120 |
| 4,607,679 | 8/1986 | Tsai et al. | 164/5 |

FOREIGN PATENT DOCUMENTS

| | | | |
|---|---|---|---|
| 670378 | 6/1979 | U.S.S.R. | 249/197 |

*Primary Examiner*—Kuang Y. Lin

*Attorney, Agent, or Firm*—Glenn E. Klepac

[57] ABSTRACT

A process for continuous direct chill casting of aluminum alloys, particularly aluminum-lithium alloys. The molten alloy is cast in a mold containing a header comprising delaminated vermiculite or spodumene or lithium aluminate. The header preferably comprises delaminated vermiculite blended with wollastonite, lime, silica, and wood fiber. The mixture is slurried with water, molded into shape, compressed to expel water, steam cured, and dried. The header forms ingots of good quality and has excellent resistance to attack by molten aluminum-lithium alloys.

17 Claims, 1 Drawing Sheet

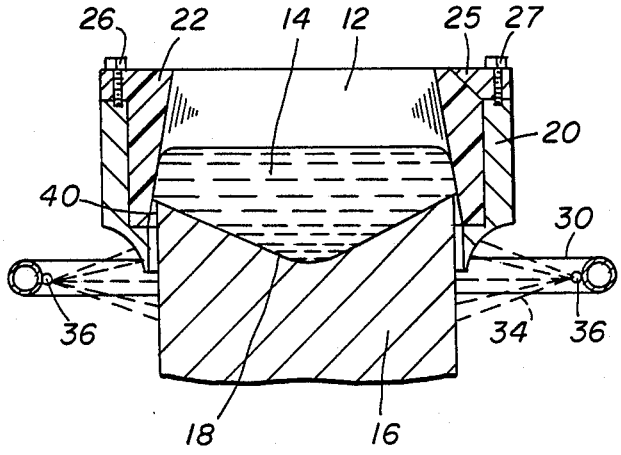
26
22
14
12
25
27
20
40
30
36
34
36
18
16

CASTING ALUMINUM ALLOYS WITH A MOLD HEADER COMPRISING DELAMINATED VERMICULITE

FIELD OF THE INVENTION

The present invention relates to the casting of aluminum alloys into solid ingot form. More particularly, the invention is a process for continuous casting of aluminum alloys using a mold having a header that is resistant to attack by the molten metal.

BACKGROUND OF THE INVENTION

Processes for continuous direct chill casting of aluminum alloys, including aluminum-lithium alloys, are known in the prior art. For example, Moritz U.S. Pat. No. 3,212,142 discloses a process and apparatus for continuous aluminum casting. The apparatus includes a mold having an outer metal shell lined with an annular header or liner of insulating material. The insulating header is made from a composition wherein asbestos fibers are distributed in an inorganic binder.

Asbestos-containing headers have performed satisfactorily in the aluminum industry for many years. However, in recent times, it has become necessary to discontinue usage of asbestos-containing materials because of health concerns. Accordingly, there is presently a need for asbestos-free headers giving aluminum casting performance comparable to headers in which asbestos is present.

It is a principal object of the present invention to provide an aluminum casting process utilizing a mold having a header wherein asbestos is replaced by a suitable substitute material.

A related objective of the invention is to provide a process for casting aluminum-lithium alloys utilizing a header that is resistant to attack by the molten metal.

Additional objectives and advantages of the invention will become readily apparent to persons skilled in the art from the following detailed description of our invention.

BRIEF DESCRIPTION OF THE DRAWING

The sole FIGURE is a cross-sectional view of a continuous casting apparatus for performing aluminum alloy casting.

SUMMARY OF THE INVENTION

In accordance with the present invention there is provided a process for casting molten aluminum alloys into solid ingot form. The alloy is preferably an aluminum-lithium alloy comprising predominately aluminum and at least about 1 wt% lithium. The alloy also may comprise at least about 1.5 wt% or at least about 2 wt% lithium. The process includes a step wherein the molten alloy is cast in a mold having a header containing delaminated vermiculite. The process is preferably performed continuously and includes a step wherein coolant is continuously applied to the cast ingot.

The header is preferably substantially asbestos-free. A preferred header contains no asbestos and is formed from a mixture comprising about 15–40 wt% lime, about 15–40 wt% siliceous component, about 10–70 wt% delaminated vermiculite, about 0–55 wt% wollastonite, and about 0–10 wt% organic fiber. Vermiculite preferably comprises about 12–25 wt% of the mixture, more preferably about 12–20 wt%. A particularly preferred mixture comprises about 12–15 wt% vermiculite.

The vermiculite may be replaced in whole or in part by spodumene or lithium aluminate.

Wollastonite preferably comprises about 15–55 wt% of the mixture, more preferably about 15–50 wt%. A particularly preferred mixture comprises about 30–50 wt% wollastonite.

When organic fiber is used, it comprises about 1–8 wt% of the mixture. About 2 wt% wood fiber is employed in a particularly preferred mixture.

Lime and the siliceous component each preferably comprise about 15–35 wt% of the mixture, more preferably about 15–25 wt%. A particularly preferred mixture comprises about 23 wt% lime and about 21 wt% silica. After the mixture is formed and heated, the lime and siliceous component combine to form an inorganic matrix comprising calcium silicate hydrate. The matrix preferably has a composition approximating that of tobermorite.

DETAILED DESCRIPTION OF A PREFERRED EMBODIMENT

There is shown in the FIGURE a continuous casting apparatus 10 for direct chill casting of an aluminum-lithium alloy. Molten metal at a temperature of about 716° C. (1320° F.) is introduced into an interior portion or chamber 12 of the apparatus 10. The metal initially forms a molten pool 14 above a solid ingot or shell 16. The pool 14 and ingot 16 are separated by a solidus line 18. The aluminum-lithium alloy has a solidus temperature of about 593° C. (1100° F.).

The apparatus 10 also includes a mold comprising an outer metal container 20 and an inner header or liner 22. The header 22 contacts the molten metal pool 14 and insulates the container 20 from the pool 14. The header 22 is kept in place by a clamp or retaining clamp 25 overlying the metal container 20 and an outer portion of the header 22. The clamp 25 is fastened to the container 20 by metal bolts 26, 27 or other preferred attaching means. A spray bar 30 adjacent the mold contains a coolant 32 for lowering temperature of the ingot 16 and lower portions of the metal container 20. The direct chill coolant emerges as a spray 34 from openings 36 in the spray bar 30. For most aluminum alloys, the preferred coolant is water. However, ethylene glycol is utilized for cooling alloys containing more than about 1.5 wt% lithium in order to reduce the risk of explosions.

A parting composition is applied to outer surface portions 40 of the ingot 16 as it forms in the mold. The parting composition is preferably an alpha-olefin oligomer which reduces friction between the mold and such surface portions 40. In the absence of lubrication, the continuously forming ingot would tear on the mold surface. Tears are defects on the ingot surface 40 and they also facilitate bleedouts of molten metal which may come into direct contact with the coolant 34. It is particularly desirable to avoid such bleedouts in casting aluminum-lithium because of the danger posed by explosion.

Additional details of continuous direct chill aluminum-lithium casting processes are found in Laemmle et al U.S. Pat. No. 4,602,670; Tsai et al U.S. Pat. No. 4,607,679; and Jacoby et al U.S. Pat. No. 4,628,985. The disclosures of such patents are incorporated herein by reference, to the extent consistent with the present invention.

Particularly desirable results in casting aluminum alloys have been obtained with a continuous casting apparatus 10 having an asbestos-free header 22. A particularly preferred header is made by forming an aqueous slurry with a mixture comprising delaminated vermiculite, wollastonite, hydrated lime, finely divided silica, and wood fibers. The slurry is shaped and compressed to expel a large portion of the water and form a densified mixture. The shaped and compressed material is then subjected to an elevated temperature while minimizing evaporation of water. The latter step is preferably performed by placing the shaped product in an autoclave in the presence of steam at superatmospheric pressure. The lime and silica thereby react to form a tobermorite crystalline matrix. Finally, the header is dried at a temperature above the boiling point of water to remove free water.

As used herein, the term "delaminated vermiculite" refers to vermiculite that is delaminated by heating or by any of several known chemical delamination processes. Chemically delaminated vermiculite is particularly preferred. After production, the suspension of chemically delaminated mineral is subjected to a wet-classification treatment in which larger particles of the mineral are removed. For use in making headers suitable for the present invention, the suspension is wet-classified to an average particle size of less than about 50 microns. Delaminated vermiculite comprises about 10–70 wt% of the mixture, preferably about 10–50 wt% and more preferably about 12–25 wt%.

Wollastonite is a crystalline form of anhydrous calcium silicate. The mixture comprises about 0–55 wt% wollastonite, preferably about 15–55 wt% and more preferably about 30–50 wt%.

Lime comprises about 15–40 wt% of the dry mixture, preferably about 15–35 wt% and more preferably about 15–25 wt%. The lime may be any suitable hydrated lime or quicklime.

The siliceous component of the mixture may be any of a wide variety of substantially pure sources of silica. These may include silica, diatomaceous earth, and similar materials. The siliceous component comprises about 15–40 wt% of the dry mixture, preferably about 15–35 wt% and more preferably about 15–25 wt%.

In a preferred embodiment, the mixture contains, in addition to vermiculite, wollastonite, lime, and silica, up to about 10 wt% of an organic fiber, preferably about 1–8 wt%. The organic fiber may be wood fiber, polyester or other synthetic fiber, cotton or other natural fibers. Wood fiber is particularly preferred. The purpose of the organic fiber is to provide "green strength" to the molded header body prior to its being cured by steam and also to provide stress distribution during drying and curing.

If desired, various other inorganic substances may be added to the dry mixture. Such additives may include spodumene (a mineral containing lithium aluminum silicate), lithium aluminate, and mineral wool.

In a typical example, a dry mixture comprising approximately 23 wt% hydrated lime, 21 wt% silica, 40 wt% wollastonite, 14 wt% delaminated vermiculite, and 2 wt% wood fiber was slurried in about four to five parts water per part of dry mixture. This slurry was then molded in a pressure mold to form a header. The molded header was then cured by autoclaving in saturated steam for several hours at approximately 170° C. The cured header was dried at approximately 110° C. to reduce moisture content. The cured and dried header has a crystalline matrix that is predominately tobermorite.

The header described above was found satisfactory for continuous direct chill casting of aluminum alloys, including aluminum-lithium alloys containing more than 1.5 wt% lithium. The header is also suitable for casting alloys containing more than 2 wt% lithium. The cast ingots had excellent surface quality and the process was performed with no bleedouts. Surprisingly, the preferred asbestos-free header described above was found to perform better for casting aluminum-lithium alloys than prior art headers containing asbestos.

Aluminum alloys cast by the process described above generally contain various alloying elements such as copper, magnesium, silicon, zinc, manganese, iron, and combinations thereof. In addition, alloys designated as aluminum-lithium alloys contain at least about 1.0 wt% lithium. For example, aluminum-lithium alloy 2091 contains about 1.8–2.5 wt% Cu; about 1.7–2.3 wt% Li; about 1.1–1.9 wt% Mg; about 0.08–0.16 wt% Zr; 0.20 wt% max Si; 0.30 wt% max Fe; 0.10 wt% max Mn, Cr, and Ti; 0.25 wt% max Zn, and 0.15 wt% max other impurities.

While the invention has been described in terms of preferred embodiments, the claims appended hereto are intended to encompass all embodiments which fall within the spirit of the invention.

What is claimed is:

1. A process for casting into solid ingot form a molten alloy comprising predominately aluminum, said process comprising (a) casting said molten alloy into a solid ingot in a mold having a header comprising about 10–70 wt% of a material selected from the group consisting of delaminated vermiculite or spodumene or lithium aluminate or mixtures thereof.

2. The process of claim 1 wherein said alloy comprises at least about 1 wt% lithium.

3. The process of claim 1 wherein said header is substantially asbestos-free.

4. The process of claim 1 wherein said header is formed from a mixture comprising about 15–40 wt% lime, about 15–40 wt% siliceous component, about 0–55 wt% wollastonite, and about 10–70 wt% delaminated vermiculite.

5. The process of claim 4 wherein said mixture further comprises about 0–10 wt% organic fiber.

6. The process of claim 1 wherein said header is formed from a dry mixture comprising about 15–35 wt% lime, about 15–35 wt% siliceous component, about 15–55 wt% wollastonite, about 10–25 wt% delaminated vermiculite, and about 0–10 wt% organic fiber.

7. The process of claim 6 wherein said dry mixture comprises about 1–8 wt% organic fiber.

8. The process of claim 1 wherein said vermiculite is distributed in a matrix comprising calcium silicate hydrate.

9. The process of claim 1 wherein said vermiculite is distributed in a matrix having predominately a tobermorite composition.

10. The process of claim 1 wherein said header further comprises about 20–55 wt% wollastonite.

11. The process of claim 10 wherein said header comprises about 10–50 wt% delaminated vermiculite and about 15–55 wt% wollastonite.

12. The process of claim 1 further comprising (b) cooling said ingot.

13. In a process for continuously casting into solid ingot form a molten alloy comprising predominately aluminum and at least about 1 wt% lithium, said process comprising continuously casting said molten alloy in a continuous casting mold having a header, the improvement wherein said header comprises about 10–70 wt% of a material selected from the group consisting of delaminated vermiculite or spodumene or lithium aluminate or mixtures thereof.

14. The process of claim 13 wherein said header consists essentially of about 10–70 wt% vermiculite and about 0–55 wt% wollastonite distributed in a matrix comprising calcium silicate hydrate.

15. The process of claim 13 wherein said header is formed from a mixture consisting essentially of about 15–35 wt% lime, about 15–35 wt% siliceous component, about 15–55 wt% wollastonite, about 10–50 wt% delaminated vermiculite, and about 0–10 wt% organic fiber.

16. The process of claim 13 wherein said molten alloy comprises at least about 1.5 wt% lithium.

17. The process of claim 13 wherein said molten alloy comprises at least about 2 wt% lithium.

* * * * *